US006992256B1

(12) United States Patent
Wiley et al.

(10) Patent No.: US 6,992,256 B1
(45) Date of Patent: Jan. 31, 2006

(54) EXTERNAL DISCONNECT MECHANISM INTEGRATED WITH AN ELECTRICAL SYSTEM ENCLOSURE

(75) Inventors: Brian Thomas Wiley, Shokan, NY (US); Palvin Chee Leong Chan, Rhinebeck, NY (US)

(73) Assignee: Wiley Electronics LLC, Shokan, NY (US)

( * ) Notice: Subject to any disclaimer, the term of this patent is extended or adjusted under 35 U.S.C. 154(b) by 0 days.

(21) Appl. No.: 11/161,365

(22) Filed: Aug. 1, 2005

(51) Int. Cl.
*H01H 9/20* (2006.01)

(52) U.S. Cl. ..... 200/50.26; 200/48 R; 200/321; 200/335; 335/68

(58) Field of Classification Search .. 200/50.26–50.28, 200/47, 48 R, 400, 335, 337, 338, 330, 332, 200/321; 335/68–74
See application file for complete search history.

(56) References Cited

U.S. PATENT DOCUMENTS

| | | | | |
|---|---|---|---|---|
| 2,231,072 A | | 2/1941 | Jackson | 200/168 |
| 2,849,555 A | | 8/1958 | Cellerini | 200/50 |
| 2,938,096 A | | 5/1960 | Cutler et al. | 200/168 |
| 3,287,514 A | | 11/1966 | Bachman | 200/17 |
| 3,422,238 A | | 1/1969 | Rys et al. | 200/72 |
| 3,752,947 A | | 8/1973 | Strobel | 200/172 |
| 4,190,755 A | * | 2/1980 | Rogers | 200/334 |
| 5,286,935 A | | 2/1994 | Mina et al. | 200/332 |
| 5,609,245 A | * | 3/1997 | Cassity et al. | 200/283 |
| 5,805,041 A | * | 9/1998 | Castonguay et al. | 335/177 |
| 6,100,481 A | * | 8/2000 | Castonguay et al. | 200/335 |
| 6,262,382 B1 | * | 7/2001 | Thomas | 200/293 |
| 6,459,053 B1 | * | 10/2002 | Roberts | 200/48 R |
| 6,563,062 B2 | * | 5/2003 | Kurano et al. | 200/50.24 |

* cited by examiner

*Primary Examiner*—Kyung Lee

(57) ABSTRACT

A disconnect mechanism for an electrical system that is integrated with the enclosure of the system, yet includes an external handle for closing and opening the electrical circuit. The invention utilizes the system's circuit breaker to switch the current on or off, eliminating the need for a separate external disconnect. Moving parts are limited to an external actuating handle connected by a shaft to an actuating arm, which has an opening whose inner edges press against a pin connected to the circuit breaker to trigger its movement between the on and off positions. Automatic tripping of the circuit breaker during a system overload moves the external handle to the off position, furnishing visual evidence of the systems working status. A watertight seal maintains the integrity of the electrical system's enclosure.

15 Claims, 4 Drawing Sheets

EXTERNAL DISCONNECT MECHANISM INTEGRATED WITH AN ELECTRICAL SYSTEM ENCLOSURE

CROSS-REFERENCE TO RELATED APPLICATIONS

Not Applicable

FEDERALLY SPONSORED RESEARCH

Not Applicable

REFERENCE TO SEQUENCE LISTING

Not Applicable

BACKGROUND OF THE INVENTION

This invention has been devised in the process of developing a photovoltaic inverter which is connected to the utility grid. Some utility companies require equipment which is so connected to include an external disconnect mechanism for easy and rapid disconnection by utility service personnel. In the past, this requirement has been met by adding, to the outside of the photovoltaic inverter main enclosure, a second enclosure containing a switch assembly with an external disconnect lever and terminal lugs which allow wiring connections to the photovoltaic system main enclosure. The disconnect enclosure is costly, bulky, and requires additional assembly at the time of system installation.

Photovoltaic inverters, which are connected to the utility grid, are also required to have circuit protection for the output wires. This protection may be in the form of fuses or circuit breakers. Circuit breakers are generally also manually operable as a switch, so that when they are designed into the inverter, the external disconnect is a redundant switching element. The circuit breakers are generally protected from exposure to weather by a watertight enclosure, however, and so are not accessible from outside the inverter. If they were externally operable, then the disconnect enclosure would not be needed.

There exist inventions with a circuit breaker in an enclosure, which are operated by an external lever, but none of them directly address the needs of the above application in a simple, cost-effective, reliable manner. U.S. Pat. No. 3,752,947 has an external lever and a mechanism that gives a mechanical advantage that allows large multi-pole circuit breakers to be manually operated with ease. This mechanical advantage is unnecessary for the photovoltaic inverter and would therefore increase cost unnecessarily.

U.S. Pat. No. 3,422,238 and U.S. Pat. No. 2,231,072 is mainly concerned with snap action to ensure that the disconnection process is not slowed by manual operation. To achieve the snap-action, their mechanisms have a large number of parts, including bulky springs. Modern circuit breakers have a self-contained snap-action mechanism that makes these intricate mechanisms unnecessary. Again, including this unnecessary feature is undesirable.

Further complexity is introduced in the disconnect mechanisms represented in U.S. Pat. No. 2,849,555 and U.S. Pat. No. 5,286,934 both of which involve cover-mounted handles designed to efficiently re-engage the inner mechanisms after opening and closing of the cover for maintenance. A mechanism not mounted to the cover will be simpler and thus more desirable.

U.S. Pat. No. 2,938,096 incorporates a design intended for flexibility in installation and a conversion of movement from rotation of the handle to movement on a perpendicular axis within the actuating mechanism. U.S. Pat. No. 3,287,514 contains a similar conversion. Again, a mechanism that did not require this motion conversion will be more desirable and economical.

In general, all of the above inventions are more complicated than required for this application. They will therefore be more expensive and more difficult to manufacture. They will also have an increased likelihood of breakdown and increased cost of maintenance.

Accordingly, several objects and advantages of the present invention are:

(1) to provide an externally accessible disconnect mechanism that allows circuit breakers inside the enclosure of a photovoltaic inverter or other electrical system to be switched on or off, eliminating the need for the external disconnect enclosure heretofore used in such systems;

(2) to provide an assembly whose simplicity of design reduces the chance of breakdown and the need for maintenance and makes any required maintenance extremely simple;

(3) to provide a mechanism that indicates by the position of the lever whether the electrical system is turned off or on;

(4) to provide a disconnect mechanism for a watertight enclosure;

Further objects and advantages are:

(1) to provide a disconnect assembly wherein system overload would cause the actuating handle to move to the off position through the force of gravity and without any help of an external preloaded spring or similar mechanism attached to the invention;

(2) to provide a disconnect assembly that is compatible with any generic single- or multi-pole circuit breaker;

(3) to provide a disconnect assembly that is protected from the application of excessive manual force;

(4) to provide a disconnect assembly whose handle is lockable in the off position.

Still further objects and advantages will become apparent from a consideration of the ensuing description and drawings.

BRIEF SUMMARY OF THE INVENTION

The present invention is an addition to the enclosure of a photovoltaic inverter or other electrical system, which already contains circuit breakers to meet overcurrent protection requirements. A simple mechanism allows external manual switching of the breakers, thus eliminating the need for a separate external disconnect switch and enclosure.

DETAILED DESCRIPTION—FIGS. 1 THROUGH 6—PREFERRED EMBODIMENT

Figure 2:
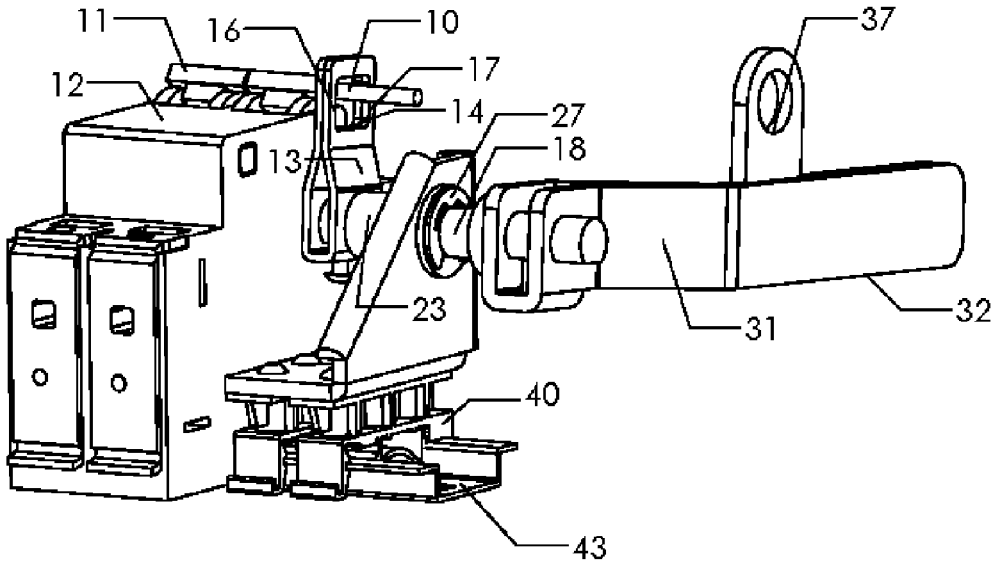
FIG. 2 shows the invention from the bottom, along with its connection to the circuit breaker.

As illustrated in FIG. 2 of the drawings, extension pin 10 is a cylindrical rod inserted into the hollow chamber of switch arm 11 of the electrical system's circuit breaker 12. Extension pin 10 is similar to pins used by the breaker manufacturer to gang multiple pins together. When one breaker in the gang trips the other breakers in the gang will also trip. The present invention makes new use of existing circuit breaker construction features in extending the gang connection to a mechanism for manual operation of the breaker. An advantage of this method of connecting to the circuit breaker is that the small mass of the connection will not disrupt the proper operation of the circuit breaker. An additional advantage of the connection method of the present invention is that extension pin 10 may be properly sized and shaped so that it will shear before allowing excessive force to be applied to the circuit breaker 12, thus preventing damage. It should be apparent to one skilled in the art that various other shapes could be used instead of a cylinder.

Actuating arm 13 is comprised of two vertical plates formed from sheet metal, their upper sections joined flush and containing an upper opening 14. The lower sections, containing a pair of identically shaped openings, are slightly separated, with a flat horizontal surface 15 of FIG. 3, joining them at the bottom. Extension pin 10 passes through upper opening 14 in actuating arm 13. Opening 14 is shaped and sized so as to accommodate variable positions of switch arm 11 in any of the major brands of circuit breakers currently on the market. The shape of opening 14 gives actuating arm 13 freedom of motion between the points where the extension pin 10 touches the forward edge 16 of opening 14 and where extension pin 10 touches the back edge 17 of opening 14. Actuating arm 13 and opening 14 comprise a lost motion actuating means, as will be clear from the following discussion and figures.

Figure 3:
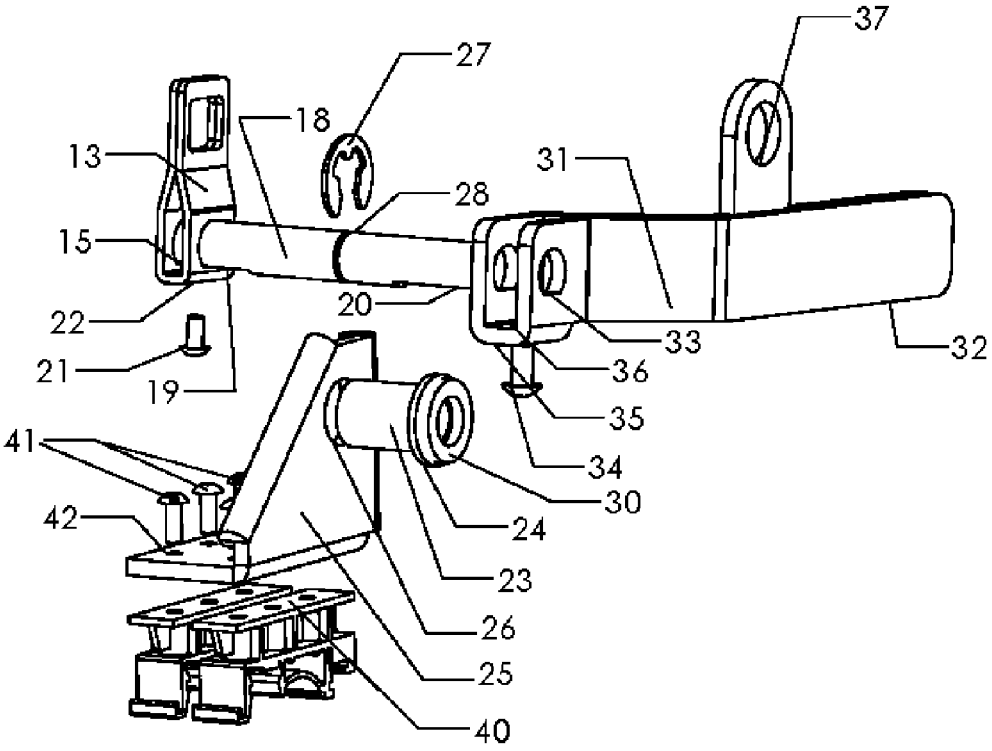
FIG. 3 is an exploded diagram of the preferred embodiment of the invention as viewed from the bottom.

As shown in FIG. 3, both sides of the lower half of actuating arm 13 are keyed with identical holes that are largely circular but flat on the bottom, shaped to accommodate the correspondingly keyed inner end 19 of actuating shaft 18. Actuating arm retaining screw 21 is fastened to threaded hole 22 on the flat bottom surface of actuating arm 13, securing actuating arm 13 to keyed inner end 19 of actuating shaft 18.

Figure 1:
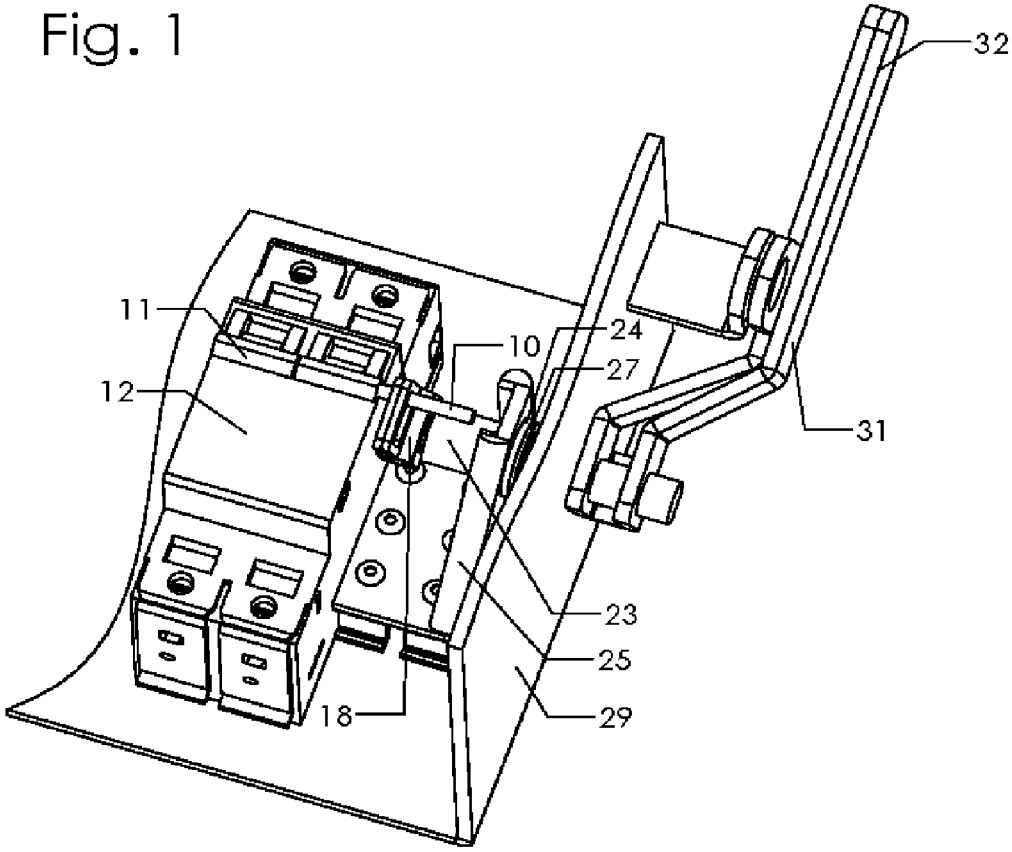
FIG. 1 shows the invention installed in the enclosure of an electrical system, with the walls of the enclosure cut away and the invention viewed from an elevated point.

Actuating shaft 18 passes through the hollow core of flanged bearing 23, which in turn passes through hole 26 in bearing-mounting bracket 25 so that flange 24 of flanged bearing 23 lies flush against bracket 25. Retaining clip 27 is inserted into retaining clip groove 28 near the center of actuating shaft 18 to prevent lateral movement of actuating shaft 18 within flanged bearing 23. FIG. 1 shows actuating shaft 18, flanged bearing 23, and bearing-mounting bracket 25 assembled, with retaining clip 27 in place, flush with flange 24 of flanged bearing 23. Actuating shaft 18 passes through a hole in the wall of enclosure 29 before attaching to the end of actuating handle 31. FIG. 3 shows watertight seal 30, which encircles actuating shaft 18 at the point where the shaft passes through enclosure wall 29, as illustrated in FIG. 1.

As shown in FIG. 3, the outer end 20 of actuating shaft 18 is keyed with a flattened lower surface for insertion through a pair of correspondingly keyed holes 33 in the base of actuating handle 31. Actuating handle retaining screw 34 is fastened to the flat bottom surface 35 of actuating handle 31 by threaded hole 36, which secures actuating shaft 18 in position with respect to actuating handle 31. It should be apparent to those skilled in the art that the handle described could be replaced by a knob, wheel or other structure, which could be gripped by an operator in order to exert rotational force.

Figure 4:
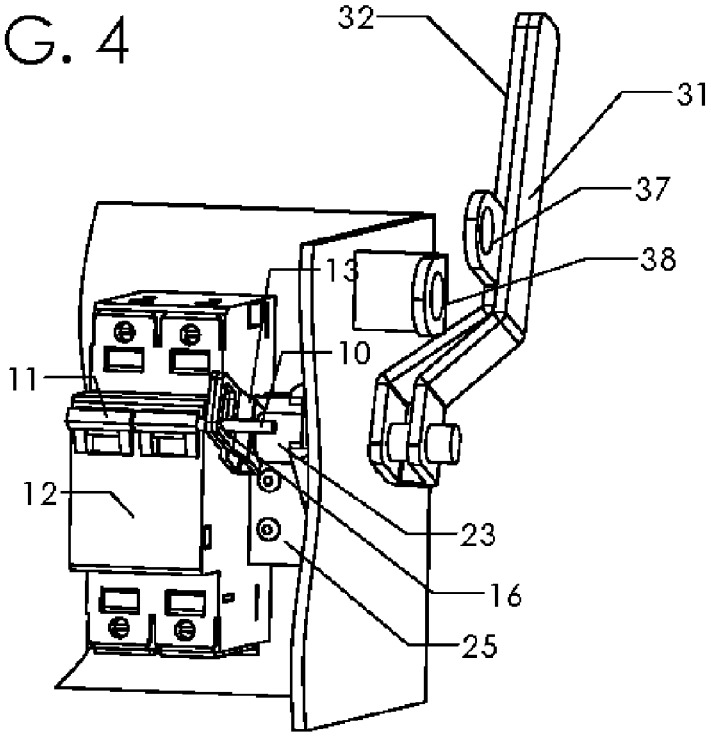
FIG. 4 shows the preferred embodiment of the invention installed in the enclosure of an electrical system, with the walls of the enclosure cut away and the invention viewed from the front, with the breaker in the on position and the actuating handle at the end of its travel.
Figure 6:
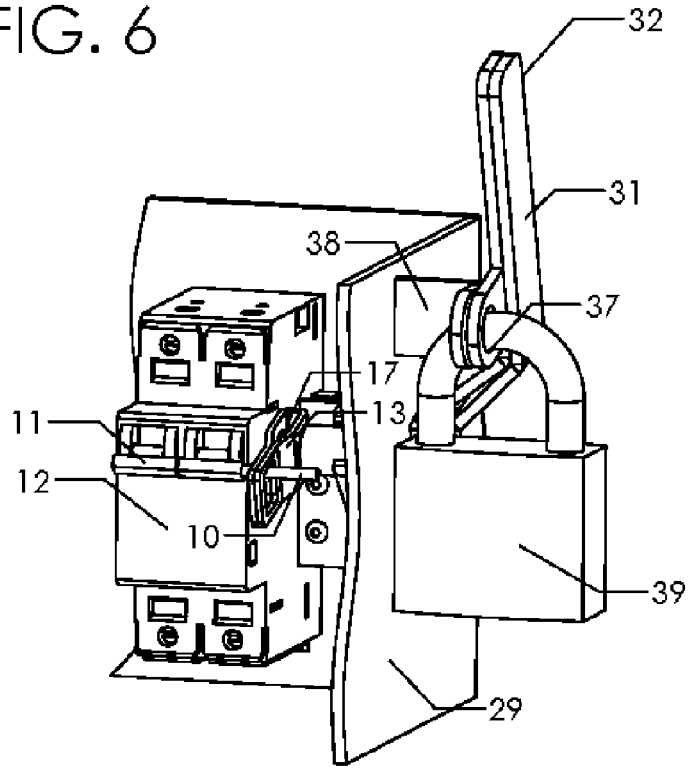
FIG. 6 shows the preferred embodiment of the invention installed in the enclosure of an electrical system, with the walls of the enclosure cut away and the invention viewed from the front, with the parts in the off position and the system locked.

As FIG. 1 illustrates, the midsection of actuating handle 31 angles away from the enclosure wall 29 so that the operator will have sufficient clearance to ergonomically grasp the gripping end 32 of handle 31. Attached to the handle, as shown in FIG. 4, is locking ring 37. Locking bracket 38 is welded to the enclosure wall 29. FIG. 6 illustrates how locking ring 37 and locking bracket 38 align, when actuating handle 31 is in the off position. Aligned at the off position, padlock 39 of up to ⅜ of an inch in diameter is used to secure the handle in the off position to allow the utility to perform maintenance.

FIG. 3 shows the bearing-mounting bracket 25, which supports the assembly by containing flanged bearing 23. Bearing-mounting bracket 25 is fastened to generic din rail mounting clips 40 by screws 41 through holes 42. FIG. 2 shows how din rail mounting clips 40 are attached onto generic din rail 43, which is fastened to the enclosure.

Figure 5:
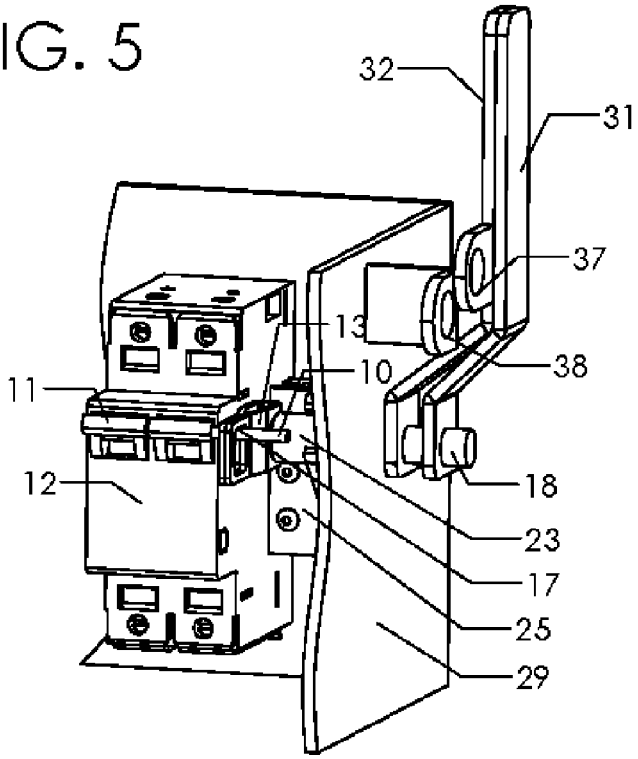
FIG. 5 shows the preferred embodiment of the invention installed in the enclosure of an electrical system, with the walls of the enclosure cut away and the invention viewed from the front, with the breaker in the on position and the actuating handle at a position of gravitational equilibrium.

Operation—FIGS. 4, 5, and 6

FIG. 4 illustrates how manually pushing actuating handle 31 away from the operator, into the on position, has caused actuating shaft 18 of FIG. 5 to rotate, moving actuating arm 13 so that the forward edge 16 of opening 14 of FIG. 2 at the end of actuating arm 13 has pressed against extension pin 10 connected to circuit breaker 12 via switch arm 11, forcing switch arm 11 to flip upward, thereby closing the electrical circuit.

FIG. 5 illustrates how actuating handle 31 will rotate back under the force of gravity to a detent position. The system is still in an on position, but actuating arm 13 has moved so that the back edge 17 of opening 14 at the end of actuating arm 13 rests against extension pin 10. In the detent position, tripping of the circuit breaker by system overload will move switch arm 111 and thus also extension pin 10. Gravitational force will keep the back edge 17 of opening 14 in FIG. 2 of actuating arm 13 in contact with extension pin 10, thus rotating actuating shaft 18 so that actuating handle 31 moves to the off position, alerting the viewer, by the alignment of locking ring 37 and locking bracket 38, that the system has been turned off. It should be apparent to those skilled in the art that a gentle spring could also be inserted to effectuate movement of actuating handle 31 to the off position when the system is intended to be installed in a different orientation with respect to gravity, at the expense of additional system complexity.

FIG. 6 shows how the same motion may be accomplished by manual operation. Pulling actuating handle 31 toward the operator, into the off position, has caused actuating shaft 18 in FIG. 5 to rotate, moving actuating arm 13 so that the back edge 17 of opening 14 in FIG. 2, at the end of the actuating arm 13 has pressed against extension pin 10 connected to circuit breaker 12 via switch arm 11, forcing the switch arm to flip downward, thereby opening the electrical circuit. In this position a lock may be inserted through locking ring 37 and locking bracket 38, preventing the circuit breaker from being turned back on by way of actuating handle 31. Even if the enclosure were to be opened, giving direct access to the circuit breaker, the position of extension pin 10 against the back edge 17 of opening 14 would prevent the circuit breaker from being turned back on.

Figure 7:
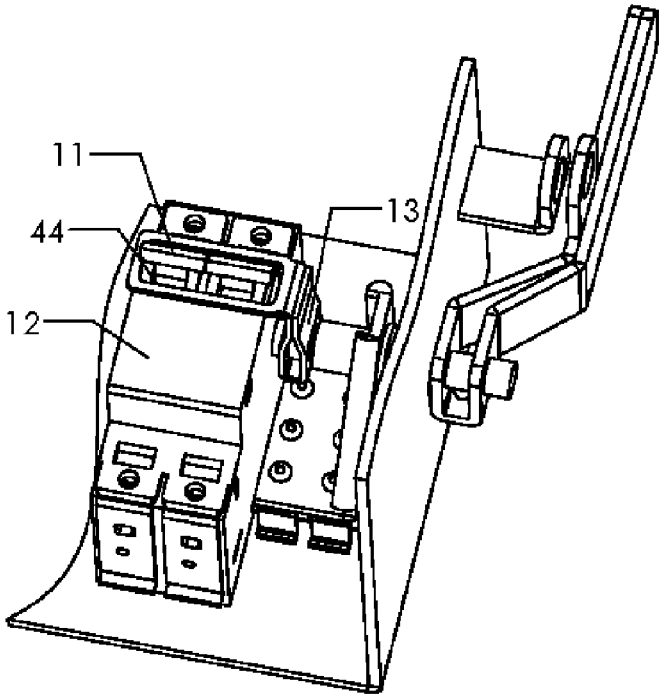
FIG. 7 shows an alternative embodiment of the invention with reduced component count.

Alternative Embodiment—FIG. 7

FIG. 7 shows that the embodiment eliminates components found in FIG. 2. This embodiment eliminates extension pin 10, replacing opening 14 of actuating arm 13 with opening 44, set at a right angle to the rest of actuating arm 13. Opening 44 is sized and shaped so as to fit around switch arm 11 of circuit breaker 12.

Operation of Alternative Embodiment—FIG. 7

Opening 44 in FIG. 7 can contact switch arm 11 of circuit breaker 12 directly. This embodiment has one fewer part, but actuating arm 13 is now more complex due to the setting of opening 44 at a right angle to the main body of actuating arm 13; thus there is little or no cost saving over the preferred embodiment. The preferred embodiment also has the advantage, due to the shape of opening 44, that it more easily accommodates circuit breakers of slightly different dimensions.

What is claimed is:

1. A device for disconnecting electrical power comprising:

a) a circuit breaker with integral switch arm, said switch arm allowing manual switching of said circuit breaker, b) an enclosure within which said circuit breaker is mounted, c) an extension means fixed rigidly to said switch arm of said circuit breaker, allowing force to be transmitted through said extension means to said actuating arm of said circuit breaker, d) a lost motion actuating means through which force may be applied to said extension means in order to move said switch arm of said circuit breaker, said lost motion actuating means capable of moving said switch arm between the on and off position, and said lost motion actuation means capable of moving to a detent position where said breaker is free to move to the off position under its own forces, e) a rotational motion means connected rigidly to said lost motion actuating means, so that rotation of said rotational motion means results in motion of said lost motion means, f) a gripping means external to said enclosure, said gripping means fixed rigidly to said rotational motion means, allowing an operator by hand to move said gripping means, thus rotating said rotational means and said lost motion actuating means, whereby an operator may manually switch said circuit breaker between the off and on positions without opening said enclosure, and said circuit breaker is still capable of tripping in response to an overcurrent condition.

2. The device for disconnecting electrical power of claim 1, additionally comprising a spring means to effectuate movement of said gripping means from the on position and to the off position upon automatic tripping of said circuit breaker.

3. The device for disconnecting electrical power of claim 1, additionally comprising a means for locking which allows a lock to be inserted when said circuit breaker is in the off position, whereby electrical power may not be reconnected without removing said lock.

4. The device for disconnecting electrical power of claim 1, wherein said extension means comprises an extension pin in the form of a cylindrical rod, inserted into a hollow chamber within said switch arm of said circuit breaker, said extension pin having a portion of its length of reduced diameter, whereby force applied to said extension pin will cause said extension pin to shear before transmitting excessive force to said switch arm of said circuit breaker.

5. The device for disconnecting electrical power of claim 1, wherein said lost motion actuating means comprises an actuating arm with an opening allowing freedom of motion between the points where said extension pin touches the forward edge of said opening and where said extension pin touches the back edge of said opening.

6. The device for disconnecting electrical power of claim 1, wherein said actuating arm is mounted on an actuating shaft and secured by means of a screw that passes through a hole in said actuating arm and presses against the keyed inner end of said actuating shaft.

7. The device for disconnecting electrical power of claim 1, wherein said rotational motion means comprises said actuating shaft, supported by a mounting bracket and secured by means of a retaining clip inserted into a groove in said actuating shaft, the outer end of said actuating shaft attached by means of a screw to the end of said gripping means.

8. The device for disconnecting electrical power of claim 1, wherein said gripping means comprises an actuating handle angled away from the wall of said enclosure so that the operator will have sufficient clearance to ergonomically grasp the end of said actuating handle.

9. A device for disconnecting electrical power comprising: a circuit breaker with an integral switch arm, said switch arm allowing manual switching of said circuit breaker, g) an enclosure within which said circuit breaker is mounted, h) a lost motion actuating means through which force may be applied to said switch arm of said circuit breaker, said lost motion actuating means capable of moving said switch arm between the off and on positions, said lost motion actuation means capable of moving to a detent position where said breaker is free to move to the off position under its own forces, i) a rotational motion means connected rigidly to said lost motion actuating means, so that rotation of said rotational motion means results in motion of said lost motion means, j) a gripping means external to said enclosure, said gripping means fixed rigidly to said rotational motion means, allowing an operator by hand to move said gripping means, thus rotating said rotational means and said lost motion actuating means, whereby an operator may manually switch said circuit breaker between the off and on positions without opening the said enclosure, and said circuit breaker is still capable of tripping in response to an overcurrent condition.

10. The device for disconnecting electrical power of claim 9, further comprising a spring means to effectuate movement of said gripping means to the off position upon automatic tripping of said circuit breaker.

11. The device for disconnecting electrical power of claim 9, additionally comprising a means for locking which allows a lock to be inserted when said circuit breaker is in the off position, whereby electrical power may not be reconnected without removing said lock.

12. The device for disconnecting electrical power of claim 9, wherein said lost motion actuating means comprises an actuating arm with an opening allowing freedom of motion between the points where said circuit breaker contacts the forward edge of said opening and where said circuit breaker contacts the back edge of said opening.

13. The device for disconnecting electrical power of claim 9, wherein said actuating arm is mounted on an actuating shaft and secured by means of a screw that passes through a hole in said actuating arm and presses against a keyed inner end of said actuating shaft.

14. The device for disconnecting electrical power of claim 9, wherein said rotational motion means comprises said actuating shaft, supported by a mounting bracket and secured by means of a retaining clip inserted into a groove in said actuating shaft, the outer end of said actuating shaft attached by means of a screw to the end of said gripping means.

15. The device for disconnecting electrical power of claim 9, wherein said gripping means comprises an actuating handle angled away from the wall of said enclosure so that the operator will have sufficient clearance to ergonomically grasp the end of said actuating handle.

* * * * *